US008757135B2

(12) United States Patent
Vanhatalo

(10) Patent No.: US 8,757,135 B2
(45) Date of Patent: Jun. 24, 2014

(54) SPLITTING WEDGE

(75) Inventor: Jouko Vanhatalo, Vinkkila (FI)

(73) Assignee: Kirnuvuori Oy, Vinkkila (FI)

( * ) Notice: Subject to any disclaimer, the term of this patent is extended or adjusted under 35 U.S.C. 154(b) by 365 days.

(21) Appl. No.: 13/130,652

(22) PCT Filed: Nov. 19, 2009

(86) PCT No.: PCT/FI2009/050937
§ 371 (c)(1),
(2), (4) Date: May 23, 2011

(87) PCT Pub. No.: WO2010/058081
PCT Pub. Date: May 27, 2010

(65) Prior Publication Data

US 2011/0226228 A1 Sep. 22, 2011

(30) Foreign Application Priority Data

Nov. 21, 2008 (FI) ..... 20086108

(51) Int. Cl.
*B28D 1/32* (2006.01)

(52) U.S. Cl.
USPC ..... 125/23.01; 299/23; 279/46.1; 279/46.4

(58) Field of Classification Search
USPC ..... 125/23.01; 279/46.1, 46.4; 299/23
See application file for complete search history.

(56) References Cited

U.S. PATENT DOCUMENTS

| | | | | |
|---|---|---|---|---|
| 2,710,608 | A * | 6/1955 | Huber | 125/23.01 |
| 2,779,324 | A * | 1/1957 | Schlough et al. | 125/23.01 |
| 2,819,710 | A * | 1/1958 | Mangis | 125/23.01 |
| 2,831,668 | A * | 4/1958 | Skowronski | 299/69 |
| 2,888,916 | A * | 6/1959 | Entz | 125/23.01 |
| 3,026,865 | A * | 3/1962 | Sunada | 125/23.01 |
| 3,100,481 | A * | 8/1963 | Stefanick | 125/23.01 |
| 3,576,348 | A * | 4/1971 | Zielinski | 299/23 |
| 3,883,178 | A * | 5/1975 | Darda | 299/22 |
| 4,190,293 | A * | 2/1980 | Nieder | 299/23 |
| 4,566,736 | A * | 1/1986 | Akanuma et al. | 299/23 |
| 4,577,613 | A * | 3/1986 | Porsfeld | 125/23.01 |
| 5,547,001 | A * | 8/1996 | Cumming et al. | 144/195.4 |
| 5,867,912 | A * | 2/1999 | Hickok et al. | 30/329 |
| 7,188,910 | B2 * | 3/2007 | Saito | 299/23 |
| 2006/0054154 | A1 * | 3/2006 | Scherer | 125/23.01 |
| 2010/0218752 | A1 * | 9/2010 | Smith | 125/23.01 |

FOREIGN PATENT DOCUMENTS

| | | | |
|---|---|---|---|
| DE | 3532491 | A1 * | 3/1987 |
| JP | 2000282776 | A * | 10/2000 |

OTHER PUBLICATIONS

International Search Report, dated Feb. 3, 2010, from corresponding PCT application.

* cited by examiner

*Primary Examiner* — Lee D Wilson
*Assistant Examiner* — Tyrone V Hall, Jr.
(74) *Attorney, Agent, or Firm* — Young & Thompson

(57) ABSTRACT

A splitting wedge includes at least a wedge (1), an external sleeve (3), and a wedge sleeve (2). The wedge sleeve (2) and the external sleeve (3) are connected to one another by providing one with a flange (8, 10) and the other with a groove (7, 9), the flange (8, 10) and the groove (7, 9) being substantially perpendicular with respect to a direction of motion (B) of the wedge (1), and by arranging the flange (8, 10) in the groove (7, 9).

6 Claims, 4 Drawing Sheets

SPLITTING WEDGE

BACKGROUND OF THE INVENTION

The invention relates to a splitting wedge comprising at least a wedge sleeve and an external sleeve, each of which consists of at least two halves, and a wedge.

It is necessary to split rock and stones e.g. in various quarries and construction sites. The methods and tools used in splitting largely depend on the scale of the work and on the manner in which the material will subsequently be utilized, since different working methods may be used for merely breaking rock into smaller pieces and for splitting rock with the aim to produce as straight cleavage faces as possible. Typically, when splitting large stones and rocks, either explosives or various wedges are utilized.

In addition to their price, many other restrictions also exist for the use of explosives. It is a demanding task to master an explosive agent method, and the use of explosives is often problematic as far as occupational safety is concerned, which is why extra procedures, such as interruption of work and building various protective constructions, are usually required. The use of explosives causes noise problems and, because the method is difficult to manage, also involves a risk of broken pieces and other loose pieces bursting over even a large area, which means restrictions for the use of explosives e.g. in the vicinity of residential areas. In addition, as far as the subsequent use of the material is concerned, the blasting method produces a lot of waste rock and the material may suffer from dark stains and discoloration caused by blasting.

For many reasons, it is advantageous to split rock by using a splitting wedge. In wedge splitting, a force is applied to the rock from within, which is quite advantageous and efficient as far as the structure of the rock is concerned. No explosives are needed in wedge splitting and, as compared to blasting, it is thus an extremely safe splitting method. In wedge splitting, it is also possible to control both the direction of splitting of the rock and the straightness of the cleavage very accurately.

In prior art hydraulic wedge solutions, however, the splitting power achieved in splitting has been limited and, in addition, the structures of the wedge solutions have typically set limitations for possible uses of wedges. Furthermore, many of the known solutions are complex and expensive to implement.

BRIEF DESCRIPTION OF THE INVENTION

An object of the present invention is to provide a novel and improved splitting wedge.

A splitting wedge according to the invention is characterized in that a lower part of the external sleeve is provided with a groove of the external sleeve and an upper part of the wedge sleeve is provided with a flange of the wedge sleeve, the groove of the external sleeve and the flange of the wedge sleeve being arranged substantially perpendicularly with respect to a direction of motion of the wedge, and wherein the wedge sleeve is connected to the external sleeve by arranging the flange in the groove, or wherein the upper part of the wedge sleeve is provided with a groove of the wedge sleeve and the lower part of the external sleeve is provided with a flange of the external sleeve, the groove of the wedge sleeve and the flange of the external sleeve being arranged substantially perpendicularly with respect to the direction of motion of the wedge, and the wedge sleeve is connected to the outer sleeve by arranging the flange in the groove.

An idea underlying the invention is that the wedge sleeve and the external sleeve are arranged together such that they do not become detached from one another in any position.

An advantage of the invention is that owing to the connection structure of the wedge sleeve and the external sleeve, when necessary, wedge splitting is successful in all possible positions. This is advantageous particularly when a splitting wedge is used in dangerous places and in quarries where the wedge is often connected e.g. to automatic and/or remote-controllable devices. The structure set forth in the present application also enables an efficiency better than that of the known solutions to be achieved for the wedging power. In addition, such a splitting wedge has quite a simple structure, so it is easy and inexpensive to manufacture.

An idea underlying an embodiment is that a flange of the wedge sleeve or the external sleeve is provided with a shoulder and a groove of the external sleeve or the wedge sleeve is provided with a mating groove such that the shoulder is arranged in the mating groove.

An idea of a second embodiment is that the shoulder is uniform substantially over the entire length of the flange of the external sleeve or the flange of the wedge sleeve.

An idea of a third embodiment is that the shoulder is formed from one or more separate sections which protrude from the flange of the external sleeve or the flange of the wedge sleeve and which do not cover the entire length of the circumference of the flange.

An idea of a fourth embodiment is that the splitting wedge is provided with a spring structure arranged to press the halves of the external sleeve towards one another.

An idea of a fifth embodiment is that the splitting wedge is provided with an oil feed aperture and a lubrication groove for lubricating the sliding surfaces of the wedge and the wedge sleeve.

An idea of a sixth embodiment is that the wedge sleeve is provided with lubrication holes for lubricating the sliding surfaces.

BRIEF DESCRIPTION OF THE FIGURES

Some embodiments of the invention are described in closer detail in the accompanying drawings, in which.

For the sake of clarity, the figures show some embodiments of the invention in a simplified manner. In the figures, like reference numerals identify like elements.

DETAILED DESCRIPTION OF THE INVENTION

Figure 1A:
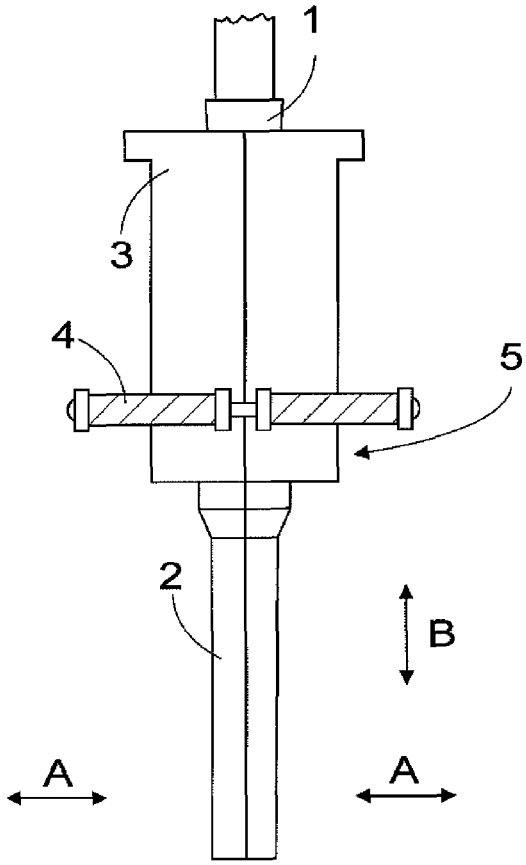
FIG. 1*a* is a schematic side view showing a lower part of a splitting wedge.
Figure 1B:
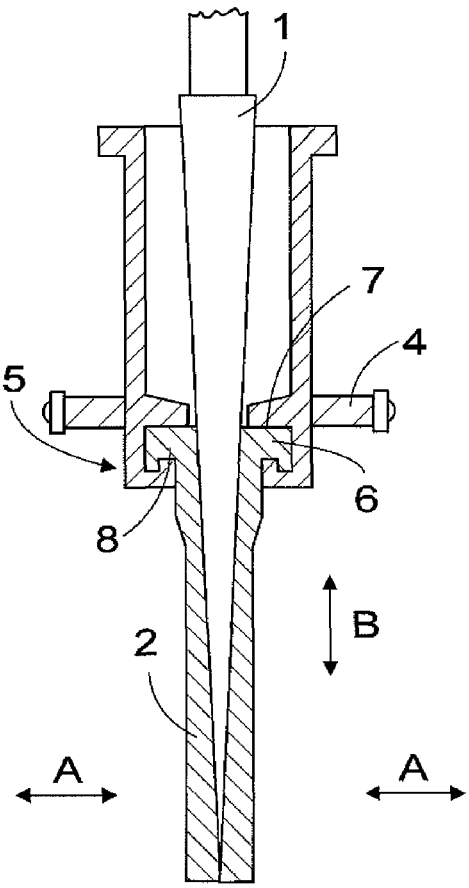
FIG. 1*b* is a schematic cross-sectional side view of the same, FIGS. 2*a* to 2*f* schematically show a detail of different embodiments of a connecting point of a wedge sleeve and an external sleeve, FIGS. 3*a* to 3*c* schematically show an embodiment of a half of a wedge sleeve such that FIG. 3*a* is a side view showing the half of the wedge sleeve.

FIGS. 1*a* and 1*b* schematically show a lower part of a splitting wedge according to the invention. The splitting wedge comprises at least a wedge 1, a wedge sleeve 2, and an external sleeve 3. The wedge sleeve 2 and the external sleeve 3 are formed from two halves and, as can be seen in FIG. 1*a*, the halves are allowed to move with respect to one another in a direction indicated by arrows A when the wedge 1 moves between the parts in a direction indicated by arrow B. In different embodiments, the wedge sleeve 2 and the external sleeve 3 may also be formed from more than two blocks.

At its one end, in the embodiment of FIGS. 1*a* and 1*b* at its upper end, the external sleeve 3 is attached to a fixed structure, such as a device driving the wedge, such that the halves of the external sleeve are not allowed to move to a substantial extent with respect to one another at said end. The external sleeve 3 is further provided with a spring structure 4 which presses the halves of the external sleeve towards one another and which may be e.g. a spring collar, coil spring, ring spring, pressure spring or a pressure-medium-operated actuator, such as a hydraulic or pneumatic actuator.

When using the splitting wedge shown in FIGS. 1*a* and 1*b*, the actual wedge 1 is moved in a direction indicated by arrow B between the halves of the external sleeve 3 and the wedge sleeve 2. The wedge 1 may be moved manually, but in industrial applications it is typical to move the wedge by means of a pressure medium actuator, such as a hydraulic or pneumatic cylinder. Preferably, the splitting wedge may be connected to a working machine, such as an excavator or a loader, in which case also the actuator moving the wedge may be connected to the hydraulics system of the particular working machine.

When the wedge 1 is pushed downwards in the figure, at the same time it pushes the halves of the wedge sleeve 2 away from one another. When the halves of the wedge sleeve 2 move away from one another, they in turn similarly push the halves of the external sleeve 3 away from one another at the lower end thereof. Thus, in the structure shown in FIGS. 1*a* and 1*b*, the halves of the external sleeve 3 do not, at least substantially, move with respect to one another at their upper end but, instead, the halves of the external sleeve are pushed away from one another at their lower end e.g. by about 20 mm and the halves of the wedge sleeve 2, in turn, are pushed evenly away from one another by the same distance, i.e. in this example 20 mm, over their entire length when the wedge 1 is pushed downwards to its extreme lower position. The halves of the wedge sleeve 2 further transmit this pressure power which is uniform over the entire length of the wedge sleeve to the material to be split, which not only maximizes the influence of the available wedging power as the force is distributed evenly also to the upper part of the wedge sleeve 2, where the leverage is higher, but also improves the controllability of the splitting result. The maximum movement of the lower ends of the halves of the external sleeve 3 and the halves of the wedge sleeve 2 depends on the structure of the splitting wedge and the spring structure 4 and it may also be less or more than 20 mm, more appropriately, however, at least 8 mm, and preferably at least 10 mm.

FIG. 1*b* shows a method of connecting an external sleeve 3 and a wedge sleeve 2. The external sleeve 3 and the wedge sleeve 2 are arranged to be connected with one another by providing a lower end 5 of the external sleeve 3 with a groove 7 and an upper end 6 of the wedge sleeve 2 with a flange 8. The groove 7 of the external sleeve and the flange 8 of the wedge sleeve are arranged substantially perpendicular with respect to direction of motion B of the wedge 1. Next, the flange of the wedge sleeve 2 is arranged in the groove of the external sleeve 3. The description of FIGS. 2*a* to 2*f* shows the connecting principle and different embodiments thereof in closer detail. The connection is such that the external sleeve 3 and the wedge sleeve 2 stay fixedly together in all stages of wedging and in all possible wedging positions. In a wedging motion, the wedge 1 is pushed downwards, pushing the halves of the wedge sleeve 2 away from one another, in which case they correspondingly push the halves of the external sleeve 3 away from one another at the lower end thereof. Similarly, during a return motion, the wedge 1 returns to its upper position and the spring structure 4 returns the halves of the external sleeve 3 back towards one another, in which case the halves of the external sleeve, in turn, push the halves of the wedge sleeve 2 towards one another. In this way, owing to the closed structure, the splitting wedge shown in FIGS. 1*a*, 1*b* may be used in all kinds of wedging positions rather than only when wedging downwards, which is often a limitation involved in the prior art splitting wedges. Further, the closed structure enables a need for maintenance and repair of the splitting wedge to be reduced.

Figure 2A:
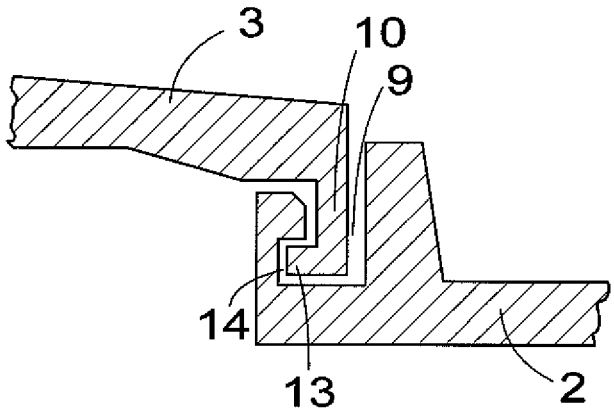

FIG. 2*a* shows a detail of a connection structure of the lower part 5 of the external sleeve 3 and the upper end 6 of the wedge sleeve 2. In this embodiment, the wedge sleeve 2 is provided with a groove 9 and the external sleeve 3 is provided with a flange 10 such that the flange is arranged in the groove. Preferably, a clearance, e.g. 1 to 2 mm, is left between the flange 10 of the external sleeve and the groove 9 of the wedge sleeve, and the edges of the flange are preferably provided with roundings or bevels, which enables the wedge sleeve 2 to turn to a slightly different position when the wedge sleeve 2 and the lower part of the external sleeve 3 move towards their extreme position.

Further in FIG. 2*a*, the flange 10 of the external sleeve 3 is provided with a shoulder 13 and a mating groove 14 is arranged in the groove 9 of the wedge sleeve such that the shoulder 13 may be arranged in the mating groove 14. Such a connection structure locks the external sleeve 3 and the wedge sleeve 2 fixedly to one another, enabling the splitting wedge to be used flexibly in different positions.

Figure 2B:
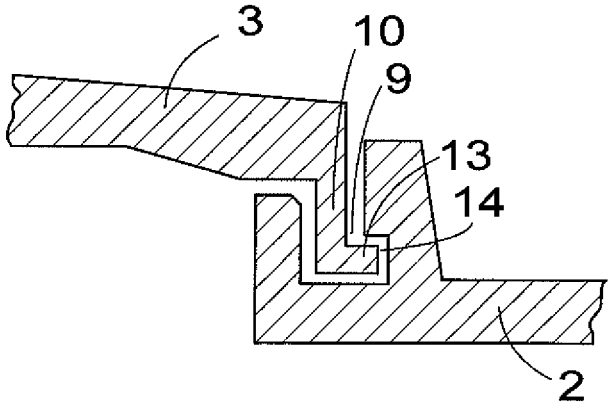
Figure 2C:
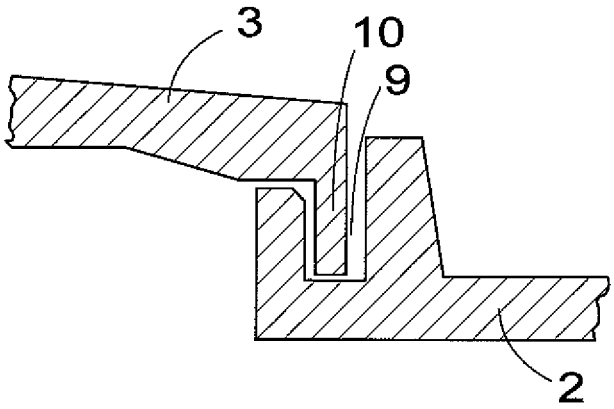

The principle of the embodiment of the connection structure shown in FIG. 2*b* is identical to that shown in FIG. 2*a*, except that in FIG. 2*a* the shoulder 13 and the mating groove 14 are arranged in a direction of the external sleeve 3, whereas in FIG. 2*b* the shoulder 13 and the mating groove 14 are arranged to point in a direction of the wedge sleeve 2. FIG. 2*c*, in turn, shows an embodiment wherein the shoulder 13 and the mating groove 14 have been omitted. Even such a structure suffices to lock the pieces to one another in different positions of use.

Figure 2D:
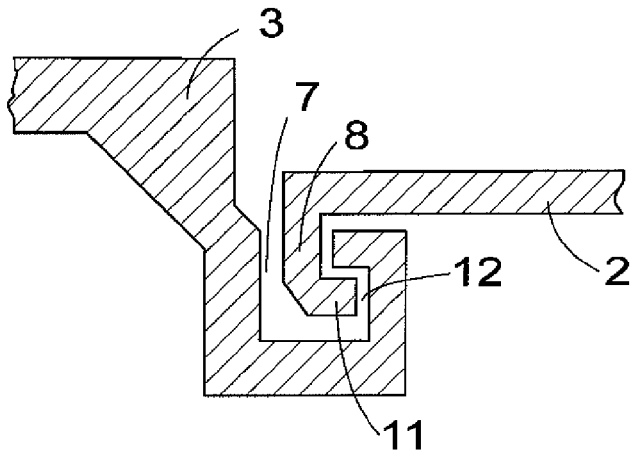
Figure 2E:
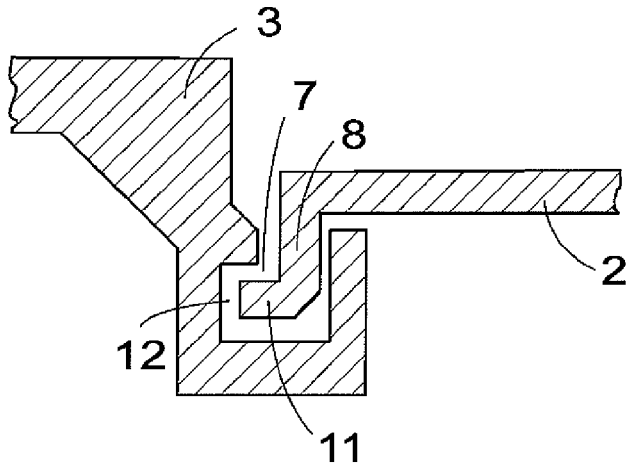
Figure 2F:
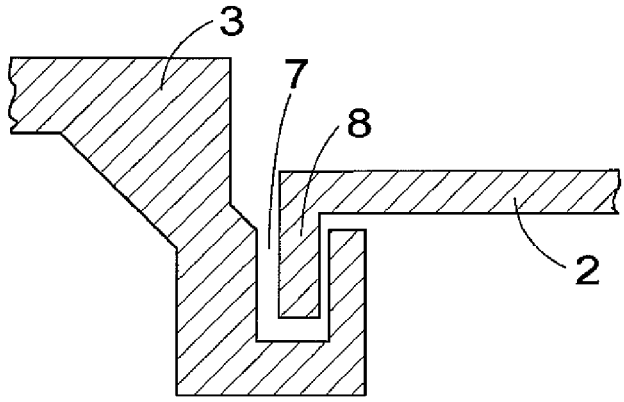

FIGS. 2*d* to 2*f* further show different embodiments of the connection structure, but as distinct from FIGS. 2*a* to 2*c*, the external sleeve 3 is provided with a groove 7 and the wedge sleeve 2 is provided with a flange 8. However, the principle of the connections is similar to that in embodiments wherein the wedge sleeve 2 is provided with a groove. In FIG. 2*d*, the flange 8 of the wedge sleeve is provided with a shoulder 11 and the groove 7 of the external sleeve is provided with a mating groove 12, which point in the direction of the wedge sleeve 2. FIG. 2*e* shows a connection structure corresponding with that shown in FIG. 2*d* but the shoulder 11 and the mating groove 12 point in the direction of the external sleeve. In FIG. 2*f*, the flange 10 is not provided with a shoulder 11 and the groove 9 is not provided with a mating groove 12. In the embodiments of FIGS. 2*d* to 2*f*, the diameter of the external sleeve may preferably be smaller than in the embodiments of FIGS. 2*a* to 2*c*.

In different embodiments, the shoulder 11, 13 shown in FIGS. 2*a*, 2*b*, 2*d*, 2*f* may be formed either to be uniform substantially over the entire length of the circumference of the flange 8 of the wedge sleeve or the flange 10 of the external sleeve, or such that the sleeve 11, 13 is formed from one or more separate sections which protrude from the flange 10 of the external sleeve or the flange 8 of the wedge sleeve and which do not cover the entire length of the circumference of the flange 8, 10. Further, in different embodiments, the outer sleeve 3 remaining outside a drill hole and/or the upper edge of the wedge sleeve 2 received in the drill hole may have a circular or square profile.

Figure 3A:
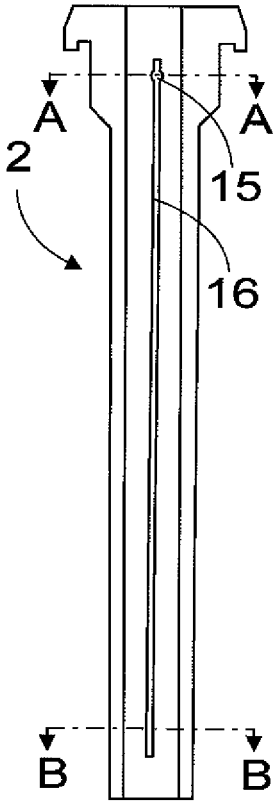
FIG. 3*b* shows it in a direction of section A-A of FIG. 3*a*, and FIG. 3*c* in a direction of section B-B of FIG. 3*a*, and FIGS. 4*a* to 4*c* schematically show a second embodiment of a half of a wedge sleeve such that FIG. 4*a* is a side view of the half of the wedge sleeve.
Figure 4A:
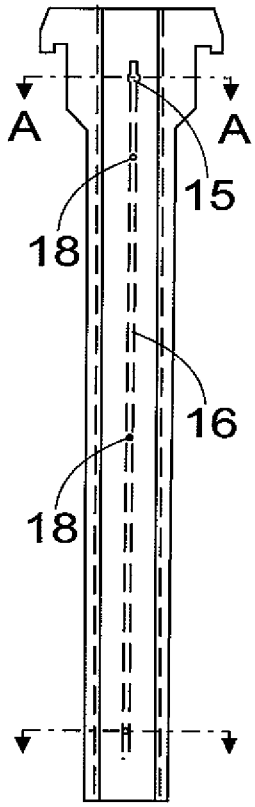
FIG. 4*b* shows it in a direction of section C-C of FIG. 4*a*, and FIG. 4*c* in a direction of section D-D of FIG. 4*a*.
Figure 3B:
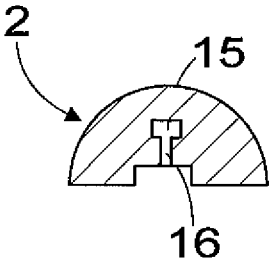
Figure 4B:
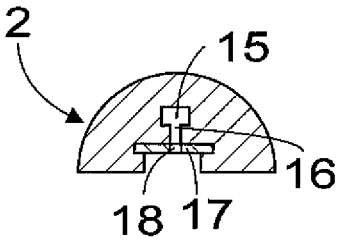
Figure 3C:
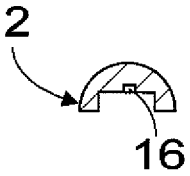
Figure 4C:
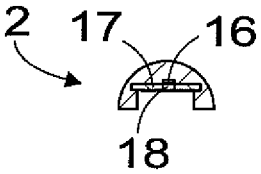

Preferably, the splitting wedge may also be provided with automatic lubrication as shown in FIGS. 3 and 4. In such a case, the halves 2 of the wedge sleeve are provided with a lubricant feed aperture 15 from which the lubricant, such as oil, is allowed to move along a lubrication groove 16, parallel with a direction of the inner surface of the wedge sleeve, to an interface of the wedge 1 and the wedge sleeve 2. This enables friction to be reduced between the sliding surface of the wedge 1 and the sliding surface of the wedge sleeve 2 which slide against one another, the friction decreasing the efficiency of the splitting and causing the pieces to wear down. Preferably, the inner surface of the wedge sleeve 2 may be further provided with a separate piece 17 which covers the lubrication groove 16 and which is provided with holes 18 for feeding a lubricant between the wedge 1 and the wedge sleeve 2. This enables an even more uniform lubrication of the sliding surfaces to be ensured. More preferably, the friction may be further decreased by making the sliding surfaces of the wedge 1 and the sliding surface of the wedge sleeve 2 as smooth as possible e.g. by grinding, the surface roughness being e.g. Ra 0.8.

Preferably, the splitting wedge set forth in the present application may be used for splitting e.g. stone, rock, concrete or another corresponding material. Owing to its splitting power, the wedge may be used solitarily, but wedges may also be combined in parallel, e.g. into booms of 15 to 10 wedges.

In some cases, the features disclosed in this application may be used as such, irrespective of other features. On the other hand, when necessary, the features disclosed in this application may be combined in order to produce different combinations.

The drawings and the related description are only intended to illustrate the idea of the invention. The details of the invention may vary within the scope of the claims.

The invention claimed is:

1. A splitting wedge, comprising:

a wedge sleeve and an external sleeve, each of which is formed of two halves, the halves of the external sleeve being held together elastically; and a wedge, wherein either of i) a lower part of the external sleeve is provided with a groove of the external sleeve, and an upper part of the wedge sleeve is provided with a flange of the wedge sleeve, the groove of the external sleeve and the flange of the wedge sleeve being arranged substantially perpendicularly with respect to a direction of motion of the wedge, whereby the wedge sleeve is connected to the external sleeve by arranging the flange in the groove, or ii) the upper part of the wedge sleeve is provided with a groove of the wedge sleeve and the lower part of the external sleeve is provided with a flange of the external sleeve, the groove of the wedge sleeve and the flange of the external sleeve being arranged substantially perpendicularly with respect to the direction of motion of the wedge, whereby the wedge sleeve is connected to the external sleeve by arranging the flange in the groove, wherein the flange is provided with a shoulder, and the groove is provided with a mating groove such that the shoulder is arranged in the mating groove, and wherein, when the wedge is pushed downwards, the halves of the wedge sleeve are pushed away from one another, and correspondingly push the halves of the external sleeve away from one another at a lower end thereof.

2. The splitting wedge as claimed in claim 1, wherein the shoulder is uniform substantially over an entire length of a circumference of the flange of the external sleeve or the flange of the wedge sleeve.

3. The splitting wedge as claimed in claim 1, wherein the shoulder is formed from one or more separate sections, which protrude from the flange of the external sleeve or the flange of the wedge sleeve and which do not cover an entire length of a circumference of the flange.

4. The splitting wedge as claimed in claim 1, further comprising:

a spring structure arranged to press the halves of the external sleeve towards one another.

5. The splitting wedge as claimed in claim 1, wherein the wedge sleeve is provided with a lubricant feed aperture and a lubrication groove for lubricating sliding surfaces between the wedge and the wedge sleeve.

6. The splitting wedge as claimed in claim 5, wherein the lubrication groove is arranged in the wedge sleeve and separated from the wedge by a piece provided with holes for feeding a lubricant from the lubrication groove to the sliding surfaces.

* * * * *